US011661716B1

(12) United States Patent
Jonassen

(10) Patent No.: US 11,661,716 B1
(45) Date of Patent: May 30, 2023

(54) EROSION CONTROL SYSTEM FOR PREVENTING SHORELINE EROSION

(71) Applicant: David Jonassen, Fruitport, MI (US)

(72) Inventor: David Jonassen, Fruitport, MI (US)

( * ) Notice: Subject to any disclaimer, the term of this patent is extended or adjusted under 35 U.S.C. 154(b) by 93 days.

(21) Appl. No.: 17/114,629

(22) Filed: Dec. 8, 2020

Related U.S. Application Data

(60) Provisional application No. 62/945,385, filed on Dec. 9, 2019.

(51) Int. Cl.
*E02B 3/12* (2006.01)
*E02B 3/14* (2006.01)

(52) U.S. Cl.
CPC ..... *E02B 3/123* (2013.01); *E02B 3/14* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,847,868 | A * | 3/1932 | Everham | E02B 3/123 405/20 |
| 1,939,417 | A * | 12/1933 | Schulz | E02B 3/123 405/20 |
| 2,876,628 | A * | 3/1959 | Dixon, Jr. | E02B 3/123 405/20 |
| 4,227,829 | A | 10/1980 | Landry, Jr. | |
| 5,238,326 | A | 8/1993 | Creter | |
| 5,921,710 | A * | 7/1999 | Scales | E02B 3/14 405/20 |
| 6,508,607 | B1 * | 1/2003 | Smith | E02B 3/14 52/603 |
| 6,866,446 | B2 | 3/2005 | McAllister et al. | |
| 7,037,037 | B1 | 5/2006 | Smith et al. | |
| 7,210,877 | B2 | 5/2007 | Jensen et al. | |
| 7,918,623 | B2 | 4/2011 | Lacroix et al. | |
| 8,052,348 | B2 | 11/2011 | Mahan | |
| 8,678,705 | B1 | 3/2014 | Smith et al. | |
| 8,858,118 | B2 | 10/2014 | Benton, Jr. | |
| 10,214,870 | B2 | 2/2019 | Jansen et al. | |
| 10,227,744 | B2 | 3/2019 | Cho et al. | |
| 10,301,788 | B2 | 5/2019 | Benton, Jr. | |
| 2018/0119377 | A1 * | 5/2018 | Benton, Jr. | B28B 7/0064 |

FOREIGN PATENT DOCUMENTS

| | | | | |
|---|---|---|---|---|
| GB | 2245629 A * | 1/1992 | | E02B 3/14 |
| WO | WO-03035986 A1 * | 5/2003 | | E01D 19/02 |

* cited by examiner

*Primary Examiner* — Kyle Armstrong
(74) *Attorney, Agent, or Firm* — Gardner, Linn, Burkhart & Ondersma LLP

(57) ABSTRACT

An erosion control system comprising a plurality of interconnected blocks that each include an upper face, a lower face, multiple sides, and connector recesses disposed on at least some of the sides, with each the connector recesses extending inwardly from an outer surface of the respective side at which it is disposed. Each block is configured to be connected with an adjacent block with one side of each block being disposed adjacent one side of an adjacent block and at least one connector recess of each block being aligned with one of the connector recesses of the adjacent block. The adjacent blocks are connected together at aligned connector recesses by a linkage assembly, with the adjacent blocks being able to pivot relative to each other via the linkage assembly.

20 Claims, 12 Drawing Sheets

EROSION CONTROL SYSTEM FOR PREVENTING SHORELINE EROSION

CROSS REFERENCE TO RELATED APPLICATION

This application claims priority to U.S. provisional application Ser. No. 62/945,385, filed on Dec. 9, 2019, which is hereby incorporated herein by reference in its entirety.

FIELD OF THE INVENTION

The present invention relates in general to the prevention of water erosion, and in particular a shoreline erosion system for preventing the erosion of shoreline bluffs, dunes, or slopes, river banks, levees, channels and the like located adjacent a body of water due to wave and hydrostatic forces.

BACKGROUND OF THE INVENTION

Shoreline erosion is a natural process that occurs on lakes, streams, rivers and along the coast, as well as at the waterlines of other bodies of water. Shoreline bluffs, dunes, or slopes lying adjacent an open body of water may be subject to erosion from the action of waves or movement of water, which has presented a serious and longstanding landslide problem and an environmental concern. Erosion can be caused by wind-induced waves pounding against the shoreline, which erodes the shoreline and can leave a bluff having a very steep face. The steep face of the bluff is very unstable, which may lead to eventual inability of the bluff to support the weight of the dirt, sand, structures and the like, supported above the bluff. The inability of the bluff to support weight results in gradual collapse of those portions or landslides. Rising and falling water levels and the action of hydrostatic forces acting within the bluffs further contribute to the erosion of the shoreline bluffs.

SUMMARY OF THE INVENTION

The present invention provides for a sturdy and readily installable erosion control or revetment system for inhibiting shoreline erosion, which system that is selectively size adjustable, flexible and removable so as to accommodate slopes of various sizes, shapes and steepness levels. The system provides multiple interconnected blocks that form a continuous surface that generally follows the natural contour of the shoreline, including a lower portion that may be submerged in the water to minimize or inhibit the scouring effect of the water waves on a shoreline, as well as an upper portion that absorbs wave and wind action.

In one form of the present invention, the erosion control or revetment system for preventing shoreline erosion includes a plurality of interconnected blocks that each include an upper face, a lower face, and a plurality of sides, and connector recesses disposed on at least some of the sides, where each connector recess extends inwardly from an outer surface of the respective side at which it is disposed. Each block is configured to be connected with an adjacent block with one side of each block being disposed adjacent a side of an adjacent block and at least one connector recess of each block being aligned with a connector recess of an adjacent block. The adjacent blocks are connected together at aligned connector recesses by a linkage connector assembly, with the adjacent blocks configured to pivot relative to each other via the linkage connector assembly.

In particular embodiments the blocks are constructed of cast concrete and include an internal frame made of metal and embedded within the concrete. In a still further configuration, the upper face of at least some of the blocks include a plurality of parallel grooves. The connector recess may include one or more coupling rods with the linkage assembly connecting the coupling rods of the aligned connector recesses of adjacent blocks. The coupling rods may be formed by embedded perimeter frame members that are exposed at the connector recesses.

In a particular configuration, each block includes four said sides and is square, and includes a pair of connector recesses on each side. At least some of the blocks may further include a through hole extending from the upper face to the bottom face, with the through hole configured to receive a piling for securing the block. Each block may further include a plurality of hooks disposed at the upper face, with the hooks configured to enable the blocks to be lifted, such as by a crane. In particular, the hooks may be disposed within grooves on the upper face whereby the hooks are recessed from a plane of the upper face to promote stacking of the blocks. In a particular embodiment the linkage connector assembly comprises a pair of U-shaped brackets and a fastener with the U-shaped brackets configured to be disposed about coupling rods of aligned connector recesses of adjacent blocks, with the U-shaped brackets being connected together with the fastener.

Thus, the erosion control or revetment system for preventing shoreline erosion is a structure composed of multiple individually reinforced, removably interconnected, and mutually adjustable concrete blocks making the system size-adjustable to accommodate a shoreline slope of any size and sufficiently flexible to follow the natural contour of the slope. These and other objects, advantages, purposes and features of the present invention will become apparent upon review of the following specification in conjunction with the drawings.

BRIEF DESCRIPTION OF THE DRAWINGS

The drawings are not necessarily to scale and in some instances proportions have been exaggerated in order to more clearly depict certain features of the invention.

DETAILED DESCRIPTION OF PREFERRED EMBODIMENTS

Figure 1:
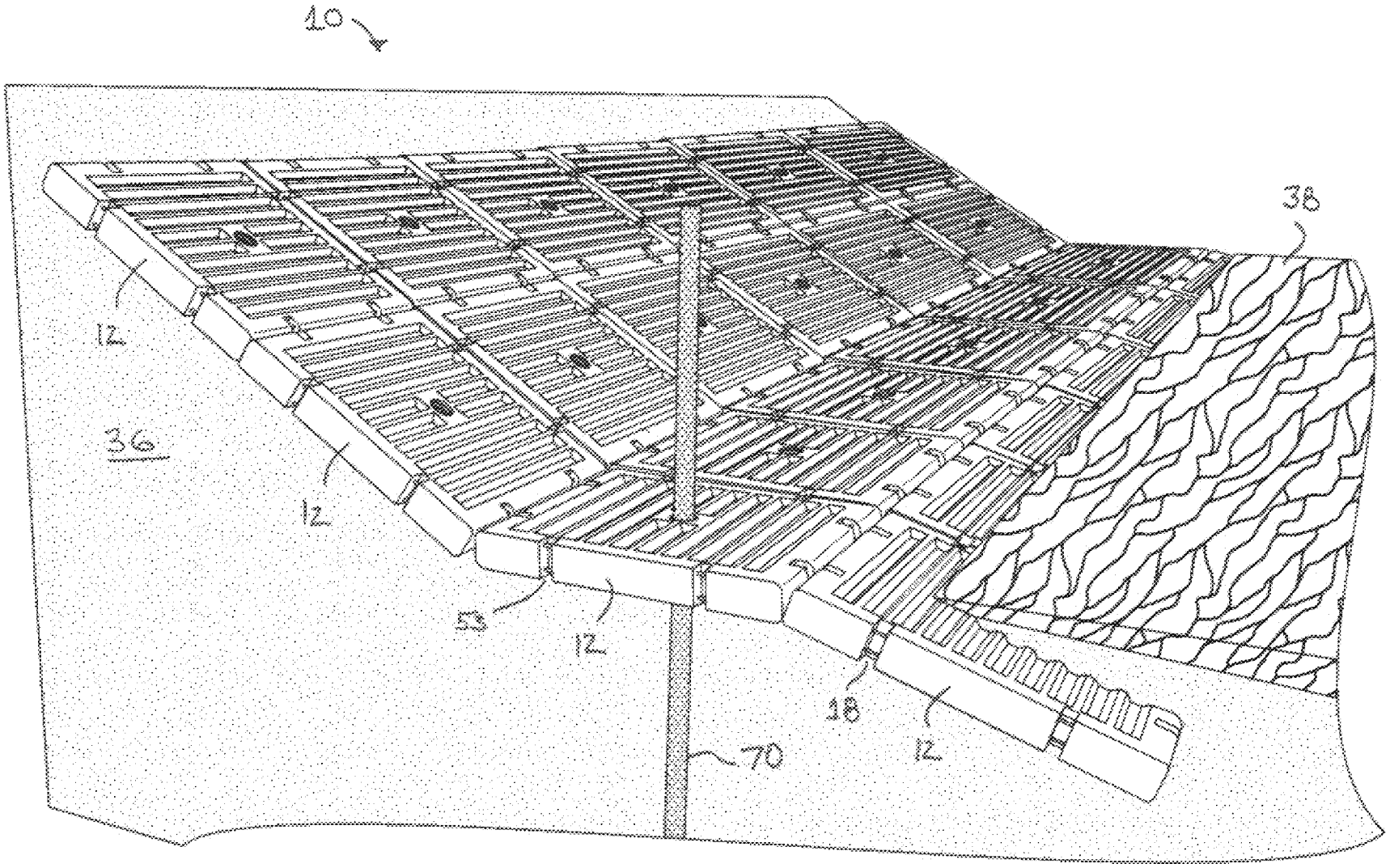
FIG. 1 is a perspective view of an erosion control system with a plurality of interconnected concrete blocks, in accordance with an embodiment of the present invention.
Figure 2:
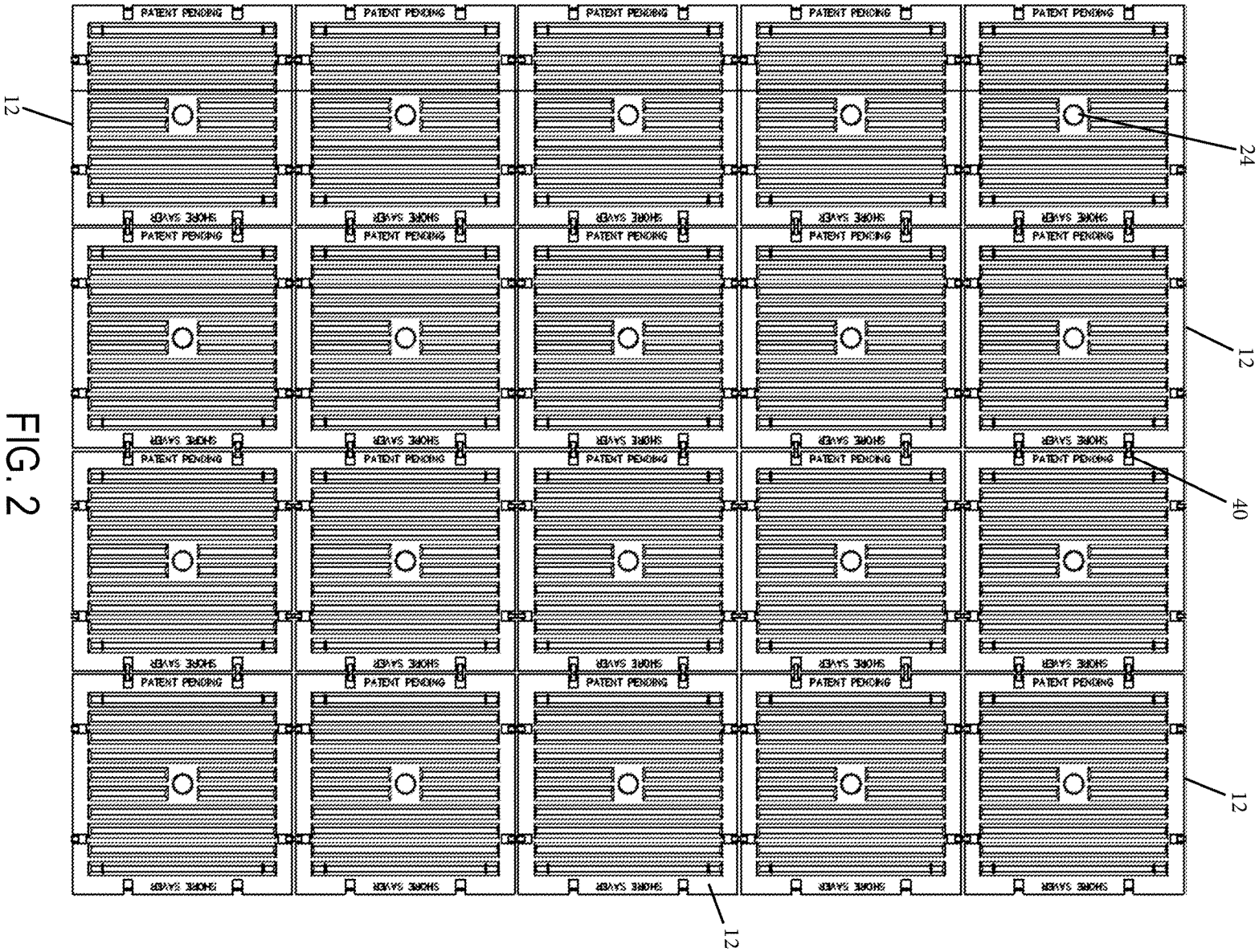
FIG. 2 is a top plan view of the revetment system illustrated in FIG. 1 with the blocks laid out in a flat orientation.

In the description which follows, like parts are marked throughout the specification and drawings, respectively. Referring now to the drawings and the illustrative embodiments depicted therein, an erosion control system or revetment system 10 of the present invention for preventing shoreline erosion is illustrated in FIGS. 1 and 2. The system 10 includes a plurality of interconnected, articulated and removable blocks 12, which in the illustrated embodiment are formed as cast concrete or cement blocks with an internal frame 11 and connecting points with the blocks 12 connected together. As illustrated in FIG. 1, the system 10 is shown installed relative to a shoreline slope or bluff area designated generally by reference numeral 36 and includes at least a front row of blocks 12 that are disposed either partially or fully within the water to form a self-adjusting scour curtain, with the first row tilting downward relative to the row there behind to which it is connected and soil or sediment being washed up onto the top surface of the first row. It should be appreciated that the water level may rise or lower such that the amount of the first row or additional rows that are submerged will vary. Remaining rows of blocks 12 may then proceed inland from the water and generally contour to the topography of the land. The system 10, as will be described in greater detail hereinafter, is configured to inhibit further erosion or scouring action of the shoreline bluff or slope 36 resulting from waves produced by wind, tides and current on a body of water 38 in the area near the shoreline bluff 36. The system 10 is also configured to minimize the effect of hydrostatic forces acting upon the shoreline bluff 36 due to backwash, ground water, drainage, or other water returning or entering the body of water 38 from the land behind the face of the slope 36.

Figure 3:
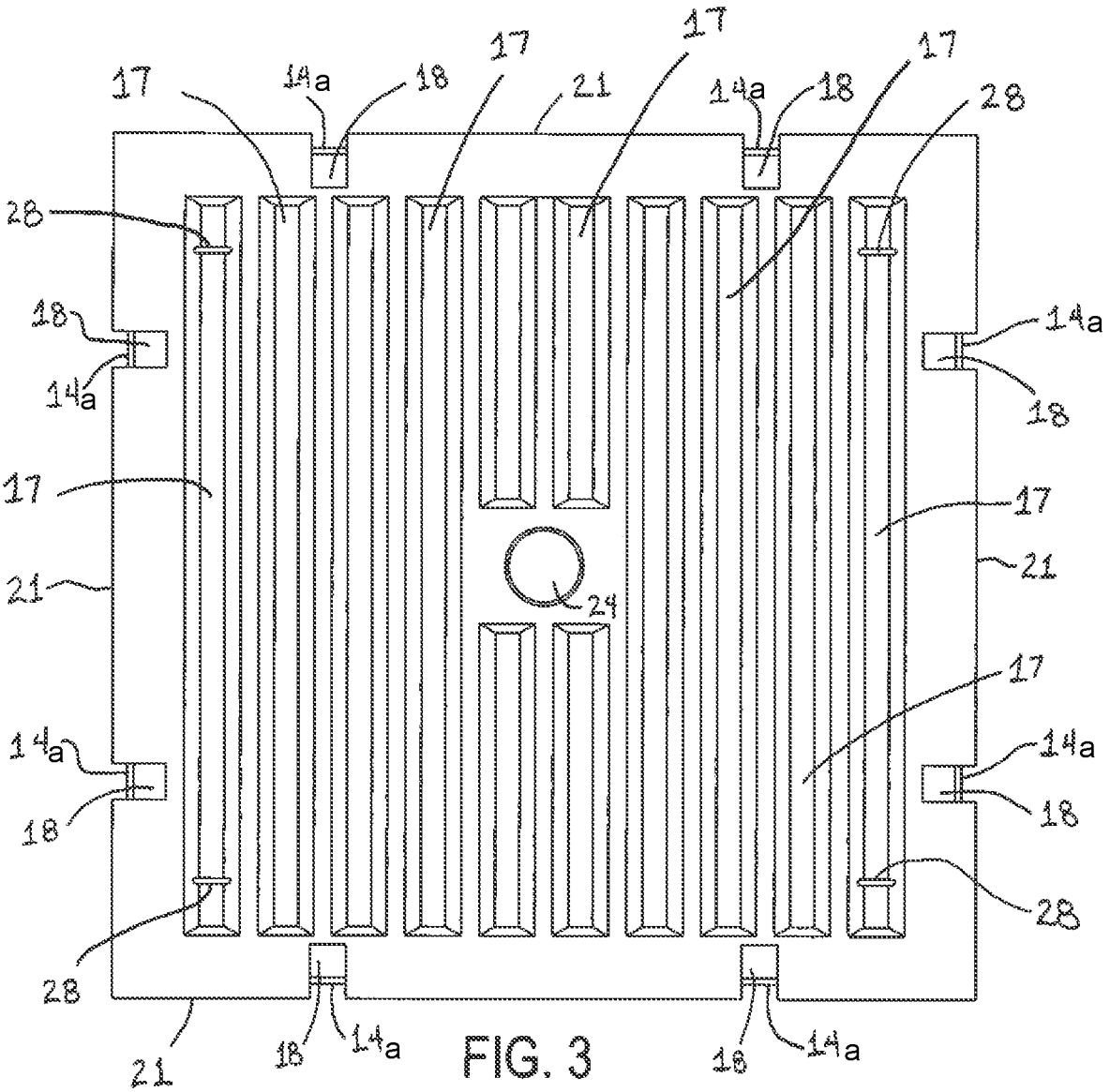
FIG. 3 is a top plan view of one of the concrete blocks of the system illustrated in FIG. 1.
Figure 4:
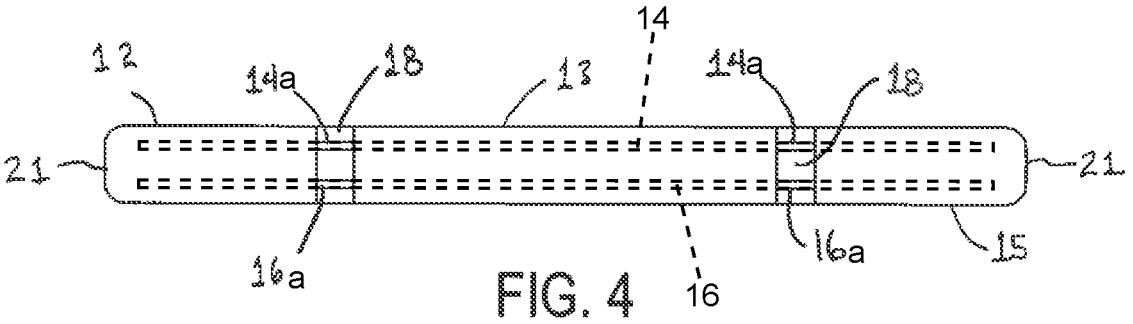
FIG. 4 is a side elevation view of the concrete block illustrated in FIG. 3.

In the illustrated embodiments of FIGS. 3 and 4, each block 12 is constructed to be generally square-shaped, although other shapes may also be employed, such as a rectangle or otherwise. Each block 12 has an upper face 13, a lower face 15, and four generally straight sides 21 with radiused or curved edges between the sides 21 and the upper face 13 and lower face 15. In the embodiment shown in FIGS. 1, 3 and 6, upper face 13 of block 12 has a grooved or corrugated surface comprising relatively deep, trough-like parallel grooves 17. As understood from FIG. 1, blocks 12 are intended to be installed such that the grooves 17 are generally parallel with the water line. These grooves 17 are intended to serve as turbulence-causing energy absorbers for the waves pounding against upper face 13 of blocks 12 installed relative to bluff 36. Another function of the corrugated surface of upper face 13 is to accumulate and retain dirt and soil, such as over time or by being specifically deposited thereon. The dirt and soil accumulated in the grooves 17 may be used to promote the growth of vegetation on the upper face 13 of the block 12 and/or bring a natural appearance to the bluff 36 that is reinforced, or covered, or protected by system 10. In the illustrated embodiments blocks 12 are dimensioned eight feet by eight feet and eight inches thick, that is each side 21 is eight feet in length and eight inches tall. It should be appreciated, however, that alternative sizes may be employed, such as depending on application, including blocks that are ten feet by ten feet and thicker for larger bodies of water or installation areas, or blocks that are six feet by six feet and thinner for smaller bodies of water or installation areas, or even sizes that are still larger or smaller In the illustrated embodiment of FIGS. 3 and 4, block 12 includes an internal frame 11 that in the illustrated embodiment is partially formed by an upper perimeter frame member 14 and a lower perimeter frame member 16 embedded or cast cemented within block 12. The upper perimeter frame member 14 lies in an upper horizontal plane that is spaced below a plane in which the upper face 13 of the block 12 lies, while the lower perimeter frame member 16 lies in a lower horizontal plane that is spaced above a plane in which the lower face 15 of the block 12 lies. Upper and lower perimeter frame members 14 and 16 include a smaller or narrower perimeter than that of the block 12, but otherwise correspond in shape to the block 12. Upper and lower perimeter frame members 14 and 16 are formed by respective four steel or metal rods connected together and each longitudinally extending along a respective side 21 of the block 12. Block 12 further includes four pairs of connector recesses 18, with in the illustrated embodiment a pair of equally spaced apart connector recesses 18 disposed along each respective side 21 of the block 12. Connector recesses 18 vertically extend the height of the block 12, such as shown in FIG. 4, and externally expose and provide access to portions of the upper and lower perimeter frame members 14 and 16 whereby the upper frame member 14 and lower frame member 16 form upper coupling rods 14*a* and lower coupling rods 16*a*, respectfully, at each recess 18 that, as discussed in more detail below, are used to connect adjacent blocks 12 together. As can be best seen in FIG. 3, recesses 18 are inwardly recessed into the block 12 such that the exposed portions of the upper and lower perimeter frame members 14 and 16 are laterally spaced inwardly from the sides 21 of the block 12. Also, as best shown in FIG. 3, each pair of recesses 18 along a given side 21 is aligned and parallel to a corresponding pair of recesses 18 on an opposing side 21 of the block 12, such that each recess 18 has one parallel and aligned corresponding recess 18 on an opposing side 21 of the block 12. Although frame members 14 and 16 are disclosed as being formed as an integrated square and forming coupling members 14*a* and 16*a* at the recesses 18, it should be appreciated that coupling members 14*a* and 16*a* may be alternatively formed and/or that the frame members 14 and 16 may be alternatively formed. For example, separate unconnected rods may be cast into the concrete, including along a given side 21 or at a given recess 18.

Figure 5:
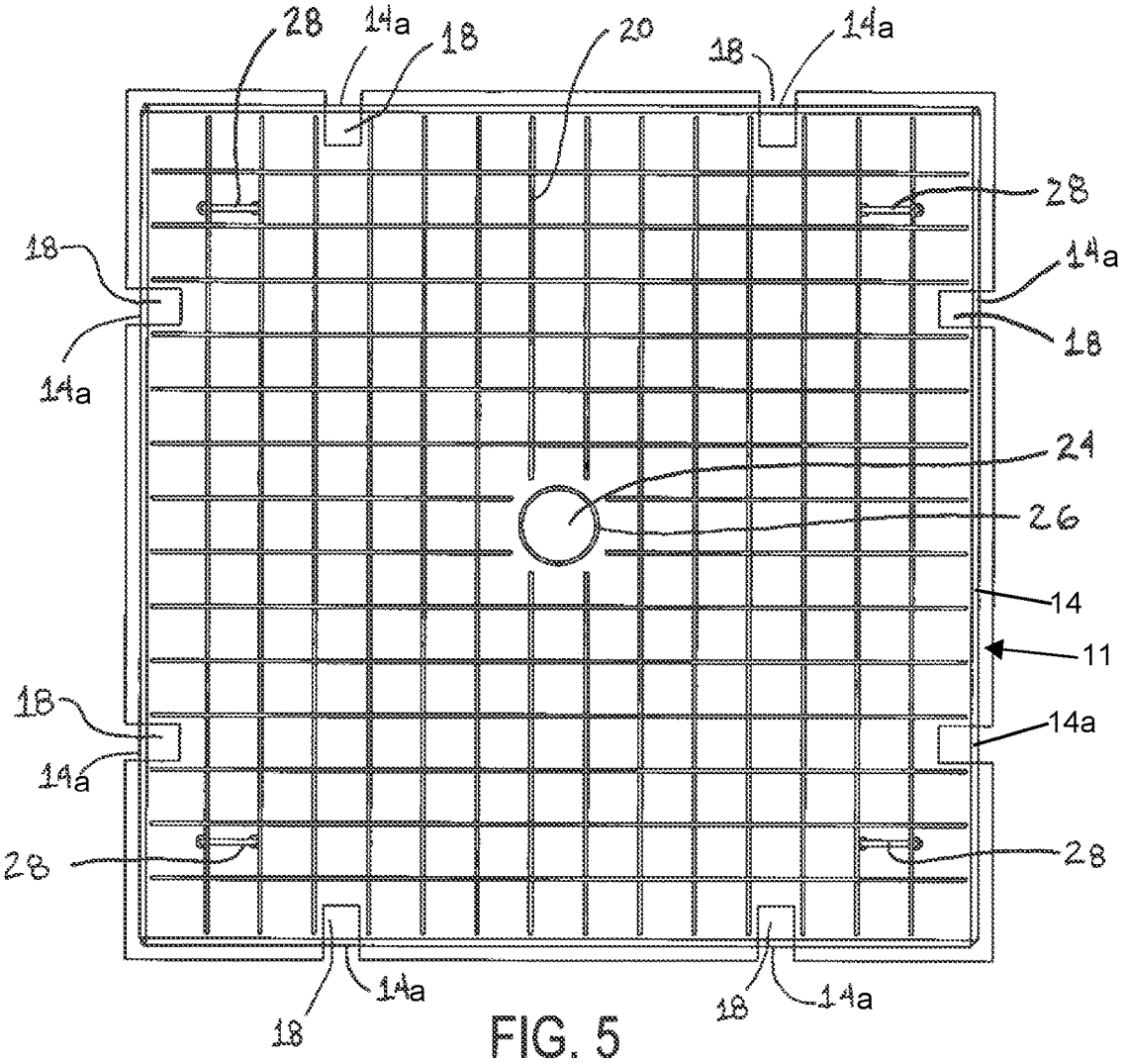
FIG. 5 is a top plan view of the concrete block illustrated in FIG. 3 cross-sectioned along a horizontal plane.
Figure 6:
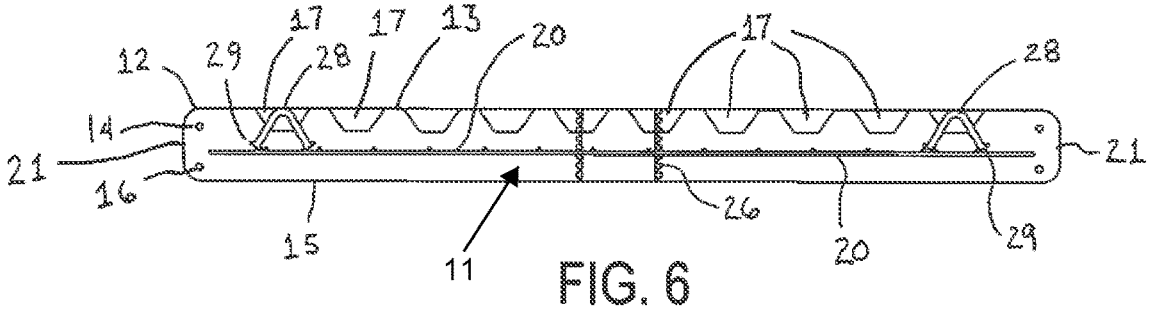
FIG. 6 is a side elevation of the concrete block illustrated in FIG. 4 cross-sectioned along a vertical plane.

With reference now to FIGS. 5 and 6, the internal frame 11 of block 12 further includes a rebar frame or mesh structure 20 that is embedded within block 12, which mesh structure 20 in the illustrated embodiment comprises multiple reinforcement rods 22 crossing one another and extending between a pair of opposing sides 21 of the block 12 to form an internal lattice frame 20. In the illustrated embodiment of FIG. 6, the mesh structure 20 lies in an intermediate horizontal plane located between the upper and lower horizontal planes of the respective upper and lower perimeter frame members 14 and 16. It should be appreciated, however, that the mesh structure 20 may be embedded in the block 12 in the same horizontal plane in which the upper or lower perimeter frame members 14 or 16 lie, and that the reinforcement rods 22, which may be made of steel or metal, may be welded or otherwise mechanically secured to either the upper or lower perimeter frame members 14 or 16. It should also be appreciated that there may be two or more mesh structures 20 embedded in the block 12 for the purpose of providing additional reinforcement. Optionally, each reinforcement rod 22 of the mesh structure 20 may also be welded to one or more reinforcement rods 22 that cross or intersect it. It will be understood that the mesh structure 20 is embedded or cemented within each block 12. Thus, each block 12 is a reinforced concrete block having an internal frame 11, including the rebar frame or mesh structure 20 embedded within it. It should be appreciated that alternatively to the lattice frame 20, or in addition to the lattice frame 20, differently configured rebar frame members may be embedded within the cast concrete.

In the illustrated embodiment, as shown in FIGS. 3, 5 and 6, at least some of the plurality of blocks 12 may further include a generally centrally positioned opening forming an anchor through-hole 24 vertically extending through block 12, i.e. extending between the upper and lower faces 13 and 15. In the illustrated embodiment of FIG. 6, the anchor through-hole 24 may be formed by a hollow, corrugated plastic pipe section 26 vertically extending through block 12 around which the concrete is cast. It will be understood that the outer surface of the pipe section 26 is corrugated to enhance engagement of the pipe section 26 with the block 12, in which the pipe section 26 is cemented or embedded. Alternatively, the anchor through-hole 24 may include a hollow metal or steel cylinder vertically extending through block 12, such as a pipe section. It should be appreciated that the upper and lower ends of section pipe 26 are externally exposed and flush with respective upper and lower faces 13, 15.

Figure 11:
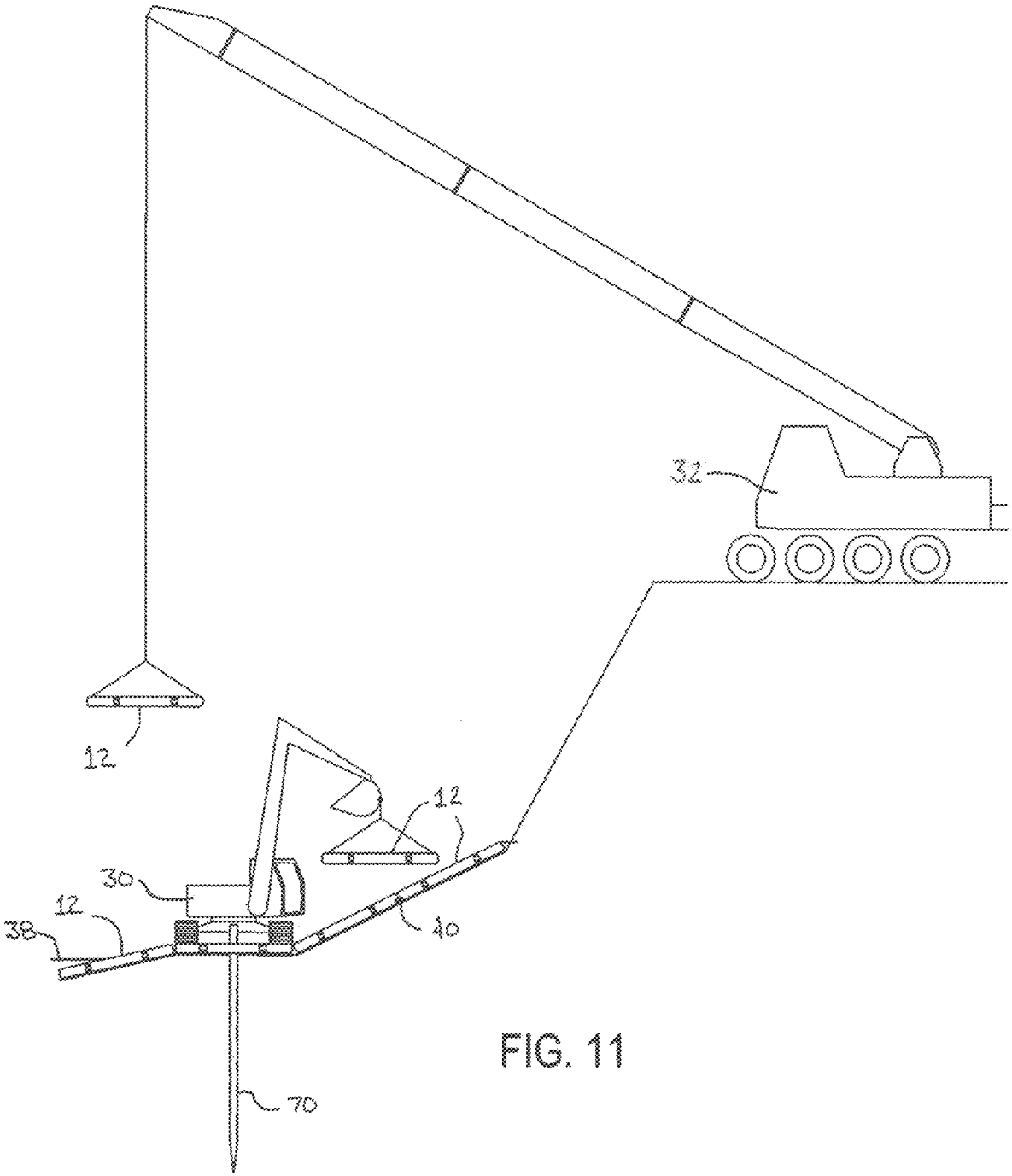
FIG. 11 is a side elevation view of the revetment system of FIG. 1 being installed.
Figure 13:
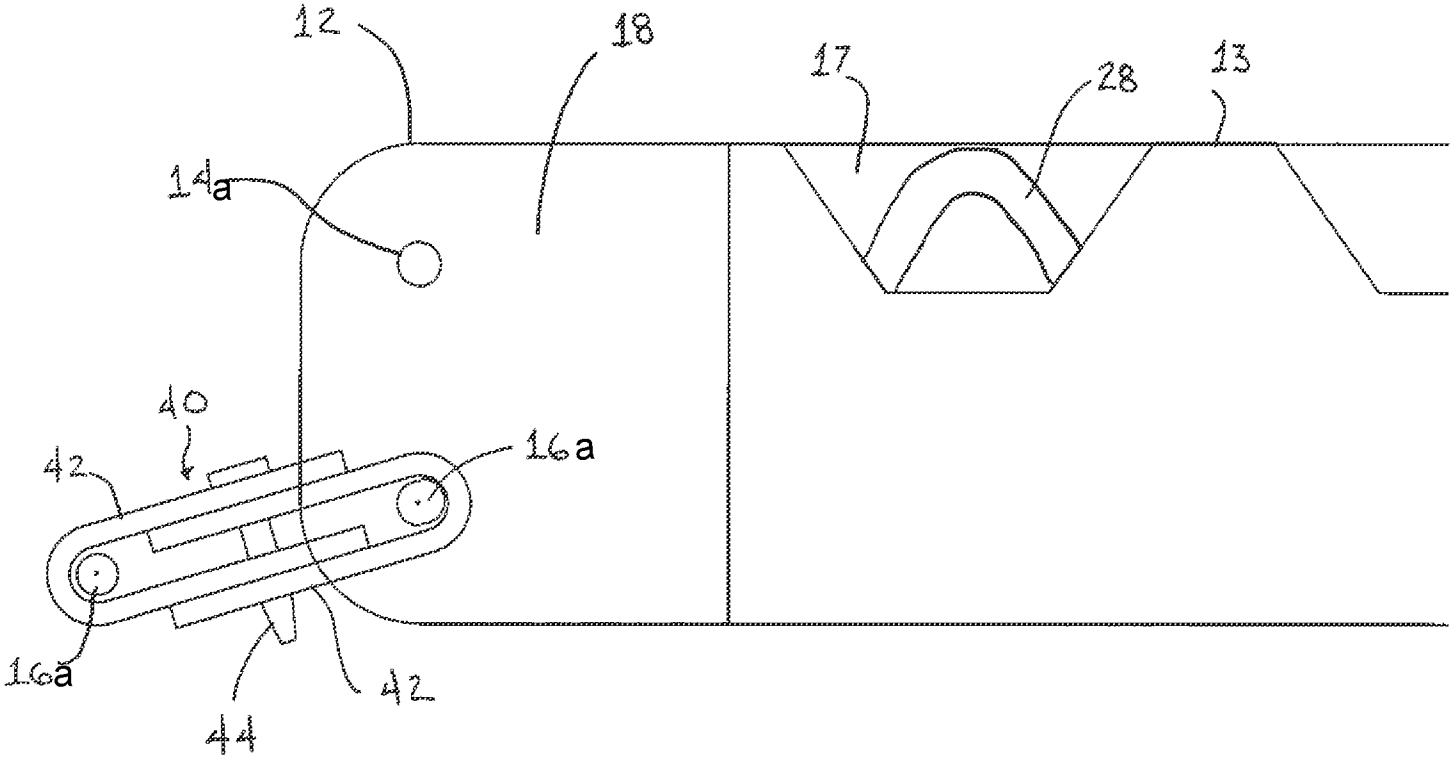
FIG. 13 is a side elevation view of an edge portion of the concrete block illustrated in FIG. 3 cross-sectioned along a vertical plane, shown connected with the link member illustrated in FIG. 12A.

With continued reference to FIGS. 3, 5 and 6, each block 12 further includes an embedded metal or steel lift eye or hook 28 disposed adjacent each corner of block 12. In the illustrated embodiment each lift eye 28 is positioned below or flush with the upper face 13 and is embedded or cast within block 12 so as to be exposed at a groove 17 such that blocks 12 may be vertically stacked, such as for storage or shipment. In the illustrated embodiment, each lift eye 28 is configured as an inverted V-shaped bracket, where the base of the inverted V-shaped bracket is inserted and cast within block 12, and the tip of the inverted V-shaped bracket vertically extends out of block 12 and within groove 17 near a respective side 21 of block 12 to form an opening. It is envisioned that the embedded ends of the inverted V-shaped brackets may include enlargements 29, such as shown in FIGS. 6 and 13, for enhanced engagement of the base of the bracket with the block 12, in which it is embedded. Optionally, each lift eye 28 may be coupled to the mesh structure 20 by welding or other known mechanical means, such as threaded bolts, hooks, fasteners, and the like. The lift eyes 28 may be used by a fork lift or excavator 30 or crane 32, shown in FIG. 11, to hoist, move, set down, or reposition blocks 12. It should also be understood that the tip of inverted V-shaped bracket is envisioned to sufficiently extend out of the block 12 and define large enough opening for a lift hook, or the like, to freely lower and hook onto the lift eyes 28. It should also be appreciated that alternative positioning of lift eyes 28 may be chosen in view of a particular shape of block 12 and desired stability of block 12 during handling of the same. It should further be understood that one or more blocks 12 may be individually unconnected from the rows of blocks 12 of the system 10 and held up, by using chains or cables as shown in FIG. 11, for grading or backfilling of the surface underneath each block 12. Additionally, lift eyes 28 may be used for attachment of various levers or braces (not shown) to each block 12 in order to distribute or transfer weight or stress on various ones of the blocks 12 of the assembly.

Figure 9:
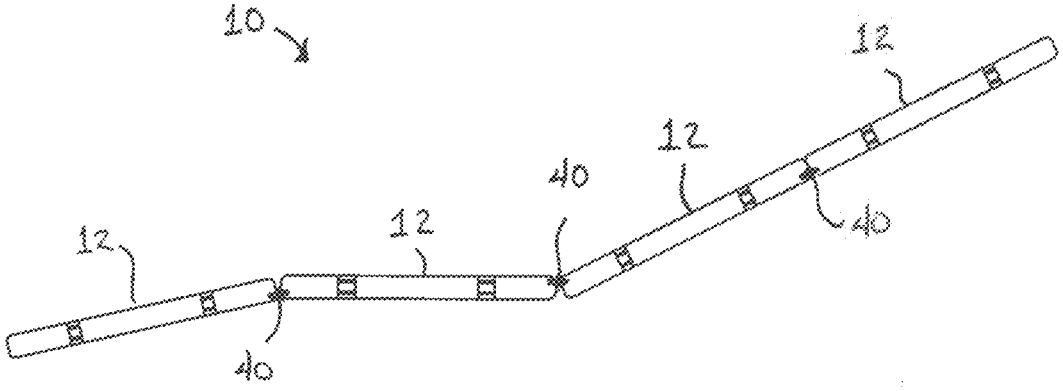
FIG. 9 is a side elevation view of four interconnected concrete blocks illustrated in FIG. 3.
Figure 12A:
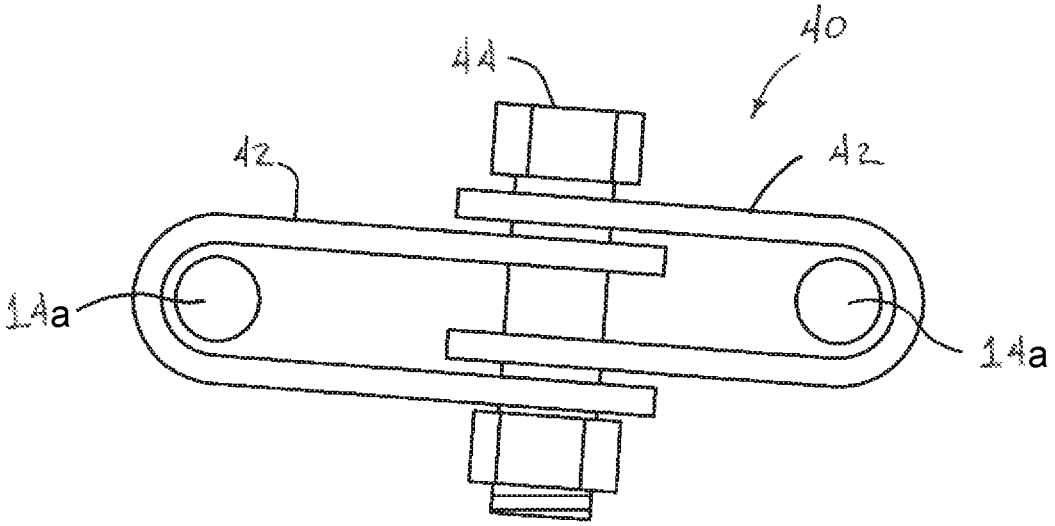
FIG. 12A is a side elevation view of a link member for interconnecting the concrete blocks of the revetment system of FIG. 1 in accordance with the present invention.
Figure 12B:
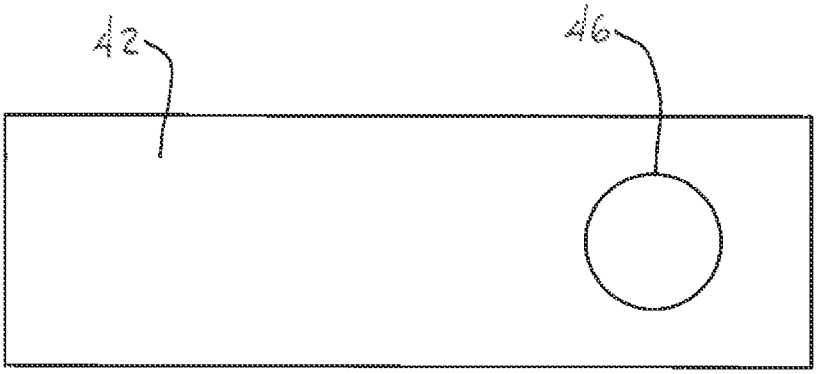
FIG. 12B is a top view of a portion of the link member illustrated in FIG. 12A.

With reference now to FIG. 9, system 10 includes a plurality of blocks 12 selectively joined together to form one or more rows and columns of blocks 12. As best shown in FIGS. 2 and 9, each side of block 12 may be selectively interlocked with an adjacent block 12 via a linkage connector or link connector assembly or member 40 at adjacent aligned connector recesses 53, such as shown in FIGS. 12A, 12B and 13. The link member 40 includes a pair of U-shaped brackets 42, the ends of which are overlapped and interlocked by a fastener 44, such as a threaded bolt, inserted through apertures 46 (FIG. 12B) in both ends of each pair of U-shaped brackets 42. As understood from the illustrated embodiment of FIG. 12A, the link member 40 is configured to intercouple respective portions of the upper or lower coupling rods 14*a*, 16*a* formed by the upper or lower perimeter frame members 14, 16 exposed in respective recesses 18 of a pair of adjacent blocks 12. For example, as shown and understood from FIG. 13, the link member 40 can be used to interlock a pair of adjacent blocks 12 by intercoupling respective portions of the lower perimeter frame members 16 exposed in respective recesses 18 of the adjacent blocks 12. It thus will be understood that when the pair of adjacent blocks 12 are interlocked by the link member 40, the adjacent blocks 12 are configured to be pivotable relative to one another, with the pivoting feature of the adjacent blocks being enhanced by the radiused edges. More specifically, each block of the pair of adjacent blocks 12 is configured to pivot about an axis extending along the portion of the upper or lower perimeter frame member 14 or 16 that is coupled by the link member 40. When so connected, the blocks 12 are able to pivot so as to conform to the topography of the surface upon which the blocks 12 are disposed. The pair of U-shaped brackets 42 may be formed of metal, steel, or other substantially rigid and moldable material.

Thus, the abutment and connection among multiple blocks 12, and the geometrical configuration of blocks 12, enables the geometrical configuration of the erosion control system 10. It should further be understood that, in order to interlock multiple blocks 12, there has to be appropriate alignment between recesses 18 of the respective blocks 12. Thus, the positioning of recesses 18 with their corresponding coupling rods 14*a*, 16*a* along the sides 21 of block 12 should be appropriately corresponding to positioning of recesses 18 of the other blocks 12 with which a given block 12 is to be interlocked. In other words, whenever two or more blocks 12 are joined together, their respective recesses 18 are configured to abut and be aligned with one another, thereby allowing an operator to interlock the two or more blocks 12 together.

To interlock two or more blocks 12 together, an operator may couple one of the pair of U-shaped brackets 42 onto or with a portion of a coupling rod 14*a* or 16*a* exposed in one of the recesses 18 of a block 12 such that the ends of the U-shaped bracket 42 extend outwardly and away from the block 12. Similarly, another one of the pair of U-shaped brackets 42 is mounted onto or coupled with a corresponding coupling rod 14*a* or 16*a* of an adjacent block 12. The opposite ends of the U-shaped brackets 42 are overlapped such that their respective apertures 43 of the pair of the U-shaped brackets 42 are aligned. The ends of the pair of U-shaped brackets 42 are then secured together by the fastener 44 inserted through the respective apertures 46 of the U-shaped brackets 42 to securely interlock the pair of U-shaped brackets 42, thereby interlocking the two blocks 12. It will be appreciated that, depending on a desired positioning angle or degree of pivoting of the two interlocked blocks 12 with respect to one another, the link member 40 may be fed through either the corresponding upper perimeter frame members 14 of the two blocks 12 or the corresponding lower perimeter frame members 16 of the two blocks 12, such as shown in FIG. 9, to interlock the two blocks 12. Such adjustability of angle provides for relative flexibility of the entire system 10, allowing the operator to relatively closely contour the shape of bluff 36. It should also be appreciated that the two or more blocks 12 may be uncoupled or unconnected from one another with selected one or more blocks 12 removed from the one or more rows and columns of interconnected blocks 12. The link members 40 thus create a hinged locking system that retains the blocks 12 together, but allows the blocks 12 to adjustably tilt or pivot with respect to each other, such as to conform to the topography of the land as well as to allow the first row scour curtain to pivot downwardly. Although shown as utilizing link assemblies 40 configured with U-shaped brackets, it should be appreciated that alternative connections may be employed such as a link connector assembly formed by conventional chain links.

Figure 7:
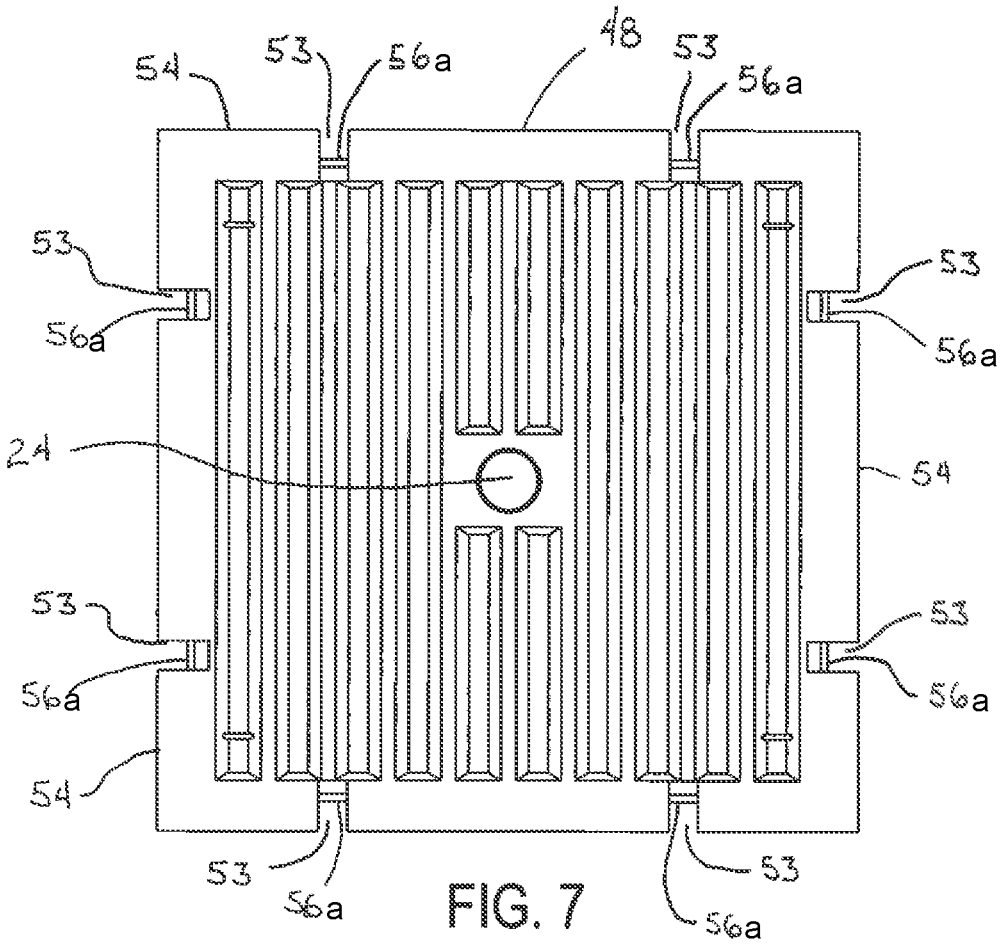
FIG. 7 is a top plan view of an alternative concrete block that can be used to form the revetment system of FIG. 1.
Figure 8:
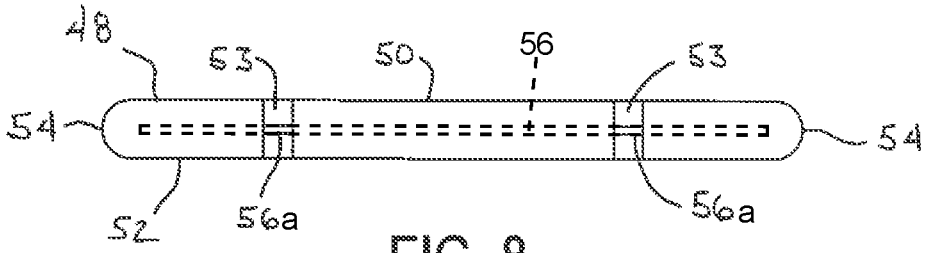
FIG. 8 is a side elevation view of the concrete block illustrated in FIG. 7.
Figure 10:
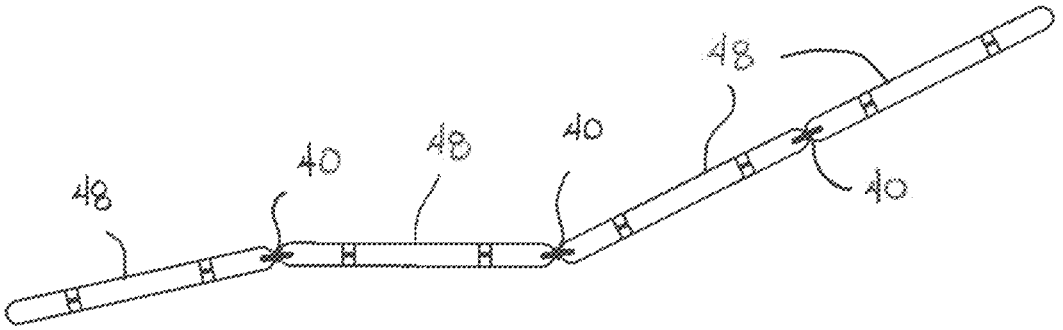
FIG. 10 is a side elevation view of four interconnected concrete blocks illustrated in FIG. 7.

With reference to FIGS. 7 and 8, an alternatively configured block 48 can be used for interconnecting with one or more other such blocks 48 to form a revetment system in like manner to system 10 for preventing shoreline erosion. Block 48 has an upper face 50, a lower face 52, and four sides 54 with connector recesses 53 disposed thereabout. Block 48 is substantially similar to block 12, except that block 48 includes only a single coupling rod 56*a* within each connector recess 53, where the coupling rod 56*a* is formed by a perimeter frame member 56 embedded or cast within block 48. The single perimeter frame member 56 lies in a central horizontal plane that is generally equally spaced below the upper face 50 and above the lower face 52 of block 48. Similar to block 12, block 48 includes the mesh structure 20, discussed above, which may or may not be coupled to the single perimeter frame member 56 by welding or other mechanical means, such as threaded bolts, hooks, and the like. Another distinguishing feature of the block 48 is that the sides 54 of block 48 are fully rounded or radiused, such as shown in FIG. 8. It will be understood that two or more blocks 48 may be interconnected by the link member 40, described above, to form the revetment system 10, such as shown in FIG. 10.

Figure 15:
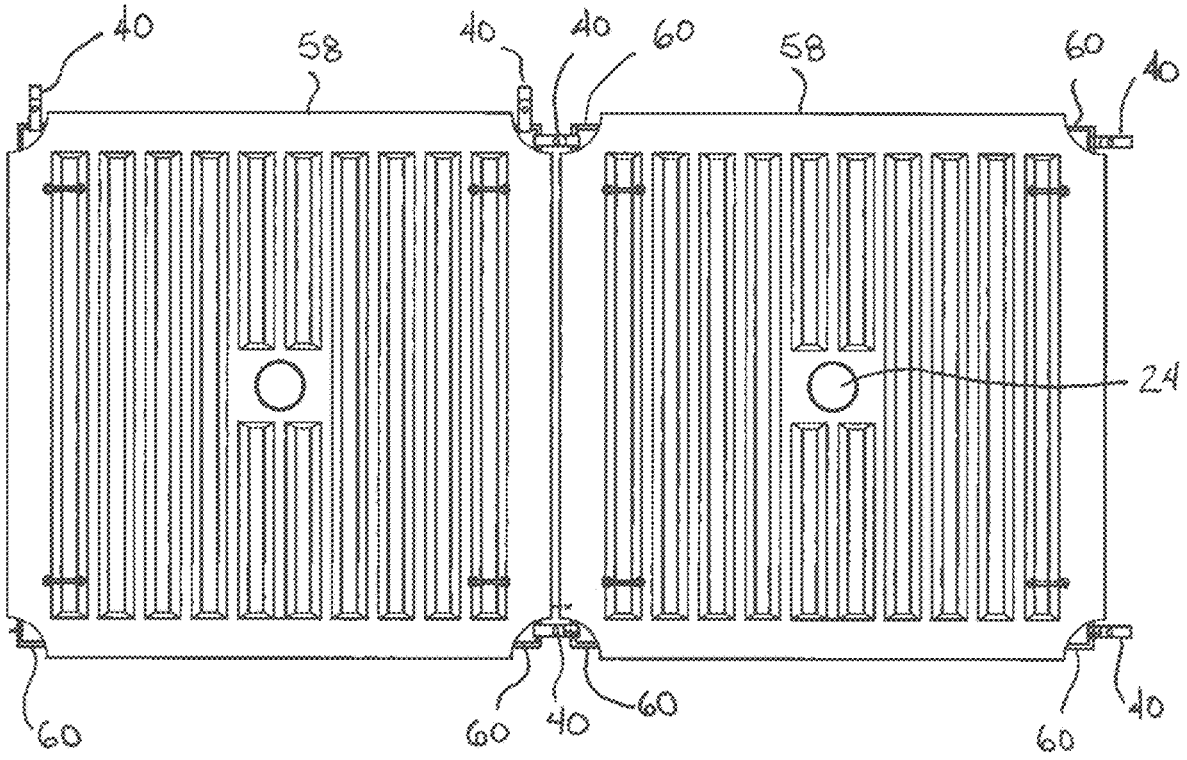
FIG. 15 is a top view of two interconnected alternative concrete blocks that can be used to form the revetment system of FIG. 1.
Figure 16B:
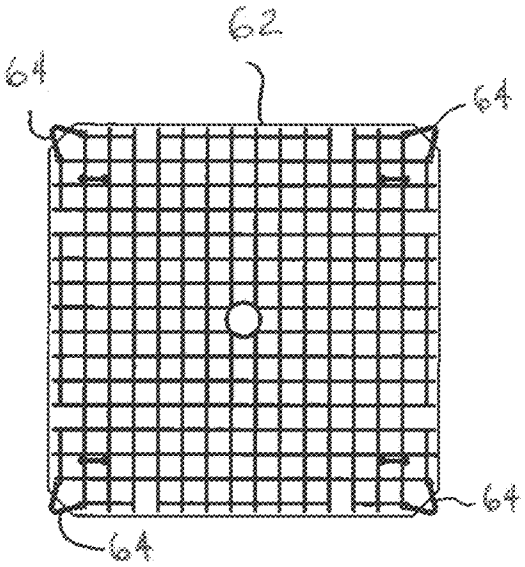
Figure 16A:
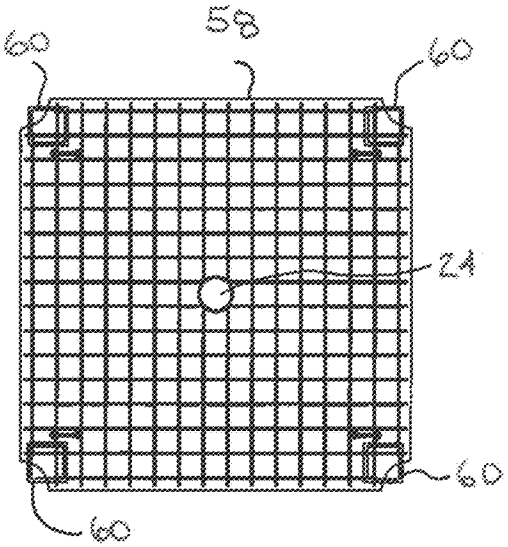
FIG. 16A is a top view of the internal frame of one of the alternative concrete blocks illustrated in FIG. 15, shown cross-section along a horizontal plane.

Turning now to FIGS. 15 and 16A, a still further alternatively configured block 58 is illustrated, where blocks 58 may likewise be interconnected together to form a revetment system in the manner of system 10 for preventing shoreline erosion. Each block 58 is substantially similar to block 12, except that, instead of recesses along the sides with coupling rods formed by exposed portions of perimeter frame members, block 58 includes four coupling rods formed as connector members 60, each horizontally oriented and disposed in a respective corner of block 58. It should be appreciated that the corner located connector members 60 are thus located in recesses that are still disposed on sides of the block 58, but form a recess on two sides. Each connector member 60 is generally square-shaped, although other shapes may be possible, and is formed of metal or steel. Connector members 60 may be coupled to the mesh structure 20 by welding or other mechanical means for additional reinforcement and stability. In the illustrated embodiment, every corner of block 58 is chamfered or scalloped to allow a portion of each connector member 60 to be externally exposed, while the other portion of each connector member 60 is cemented or embedded in block 58. It will be understood that the exposed portion of each connector member 60 forms an opening whereby the exposed portions of each connector member 60 may be used to interconnect adjacent blocks 58, such as by the link assemblies 40 discussed above to form a revetment system. It will be appreciated that in the illustrated embodiment the two-sided angular structure of the exposed portion of each connector member 60 allows a link assembly 40 to be connected to each side of connector member 60 for blocks 58 to be interconnected to form rows and similarly columns of interlocked blocks 58, such as shown in FIG. 15.

FIG. 16B illustrates still another alternative block 62 configuration that may be used to interconnect with other blocks 62 to form a revetment system. Block 62 is substantially similar to block 58 described above, except that, instead of generally square-shaped connector members, block 62 includes four V-shaped connector brackets 64, each horizontally oriented and disposed in a respective corner of block 62. Similar to block 58, every corner of block 62 is chamfered. The portion of each V-shaped connector bracket 64 that includes a pair of ends is cast cemented in block 62 and may be secured to the mesh structure 20, while the other portion of each V-shaped connector bracket 66 is exposed and defines an opening that may be used to interlock block 62 with other blocks 62 in the manner described above, or for example by chain links, retention chains, cables, and the like.

Figure 17:
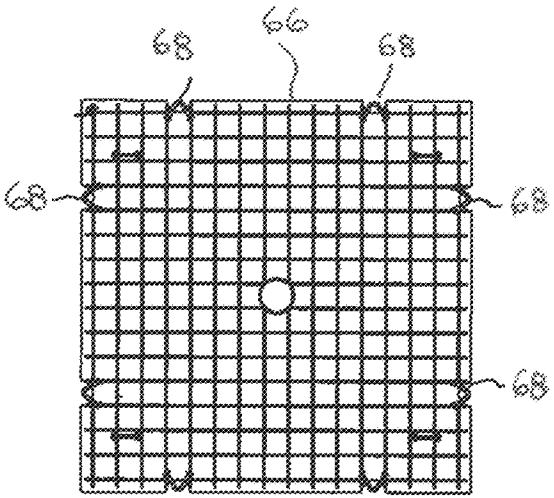
FIGS. 16B and 17 are top views of still other alternative frames of concrete blocks that can be used to form the revetment system of FIG. 1, shown cross-section along a horizontal plane.

Alternatively still, FIG. 17 illustrates yet another alternative block 66 configuration that may be used to interconnect with other blocks 66 to form a revetment system. Block 66 is substantially similar to the blocks described above, with block 66 including four pairs of coupling rods formed as separate V-shaped connector braces 68, with each pair of V-shaped connector braces 68 equally spaced along each respective side of block 66. It will be appreciated that each V-shaped connector brace 68 includes a pair of ends that are cast cemented in block 66 and may be secured to the mesh structure 20, while the other portion of each V-shaped connector brace 68 is exposed by way of a recess on a side of block 66 and defines an opening that may be used to interlock block 66 with other blocks 66 in the manner described above. Although shown as a V-shaped coupling rod in FIG. 17, it should be appreciated that alternatively shaped coupling rods may be employed, including curved or straight coupling rods.

As shown in FIGS. 1 and 11, the system 10 may also employ an anchor pile 70 as needed, where the anchor pile 70 is selectively inserted or driven through the anchor through-hole 24 of one or more blocks 12, 48, 58, 62 or 66 of the system 10 and into the ground, such as above the waterline. In the illustrated embodiment the anchor pile 70 is cylindrically shaped and configured either as a pole, a stake, or a stake with a head. Thus, the anchor pile 70 may be used to stabilize, secure, or prevent shifting of the system 10 on shoreline slopes of various shapes and sizes, including bluffs with steep faces. Additionally, one or more anchor piles 70 driven into the shoreline slope may aid in minimizing the effect of the hydrostatic forces acting within the bluffs by further compressing the surface of the bluff in the direction opposite of the outward pressure exerted by the hydrostatic forces in the bluff. It is further envisioned that steps, stairs, walls, decks, screens, or landscaping (not shown) may be installed over, or bolted to each of the plurality of blocks 12, 48, 58, 62 or 66, or attached to a framework (not shown) inserted into the anchor through-holes 24 of the plurality of blocks 12, 48, 58, 62 or 66 of the system 10.

Figure 14C:
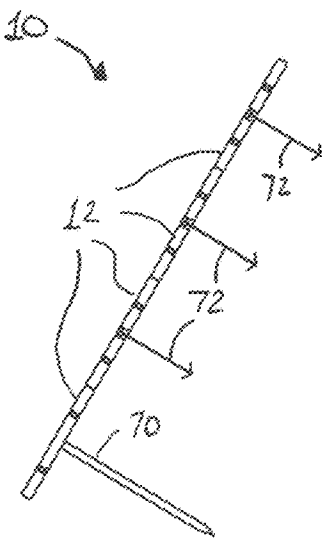
FIG. 14A-C are side elevation views of alternative applications of the revetment system illustrated in FIG. 1.
Figure 14B:
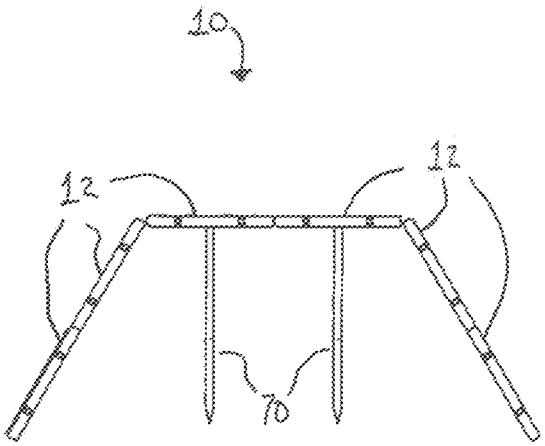
Figure 14A:
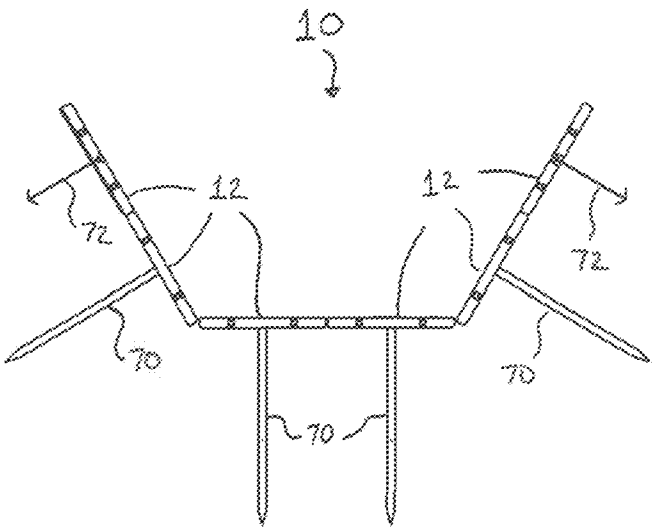

As shown in FIGS. 1 and 11, the system 10 of the present invention may be installed relative any shoreline slope or bluff with portions of the system being able to extend above and below the water level adjacent the bluff. The portion of the system that is submerged in the water may act as a scour curtain, such that the water or its waves are blocked from their scour action of the shoreline materials. Additionally, the system 10 may be installed in a channel to protect and/or prevent erosion of the banks of the channel, such as shown in FIG. 14A. Earth anchors 72 may additionally be utilized to secure upwardly sloped blocks of the system 10 to the banks of the channel. The system 10 may also be used to protect a levee, such as shown in FIG. 14B, or to protect a river bank such as shown in FIG. 14C. It is further contemplated that a heavy duty geo fabric or liner may be disposed over the surface of the slope prior to installing system 10 over the fabric and the slope. The heavy duty geo fabric may be sufficiently porous to allow water to pass while preventing the movement of the soil material of the slope there through.

In the illustrated embodiment, each block 12, 12, 48, 58, 62 or 66 is constructed as a square to be 8 ft wide by 8 ft long and be 8 inches thick, such as for a shoreline bluff at a lake, such as one of the Great Lakes. As such, the length of the sides is twelve times greater than the thickness. It should be appreciated, however, that alternative sizes may be used. For example, blocks may be constructed to be 12 ft long and 12 ft wide and be 2 ft thick, such as for an ocean coastal installation, in which case the length of the sides is six times greater than the thickness. Accordingly, it should be appreciated that a system of blocks may be constructed in which the length of the sides of the blocks to the thickness of the blocks various, such as ratios for example from four to fourteen, but in which case the lengths of the sides are greater than the thicknesses. Still further, although blocks are shown to include recesses enabling connection on all four sides, it should be appreciated that in an alternative arrangement fewer recesses may be employed, such as a single recess on each side or blocks having one or more recesses on a single side such that each block is connectable at less than each side. Still further, although each block in the system 10 is disclosed as including grooves or troughs 17 in the upper face or surface, it should be appreciated that not all blocks need to be configured as such.

Therefore, the system 10 of the present invention is a sturdy but flexible structure comprised of one or more removable/attachable and angle-adjustable blocks. The system may accommodate slopes of various sizes, shapes and steepness levels, providing a continuous upper surface portion of the system that generally follows the natural contour of the slope, thereby minimizing the stress on the system, and a continuous lower portion that may be submerged in the water to further minimize the scouring effect of the waves on the shoreline. The sturdiness and continuity of the system also allows heavy vehicles or machinery to drive over its surface.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. An erosion control system, said system comprising:

a plurality of interconnected blocks, each block comprising an upper face, a lower face, and a plurality of sides, and connector recesses disposed on at least some of said sides, wherein each said connector recess extends inwardly from an outer surface of the respective said side at which said connector recess is disposed;

wherein each said block is configured to be connected with an adjacent said block with one of said sides of each said block being disposed adjacent one of said sides of said adjacent said block and at least one said connector recess of each said block aligned with one of said connector recesses of said adjacent said block;

wherein adjacent said blocks are connected together at aligned said connector recesses by a linkage connector assembly, and wherein adjacent said blocks are able to pivot relative to each other via said linkage connector assembly; and wherein each said connector recess includes a coupling rod spanning said connector recess laterally inward from said outer surface of said sides, and wherein said linkage connector assembly connects with said coupling rods of said aligned said connector recesses of adjacent said blocks, wherein each said block includes a plurality of metal hooks disposed beneath a plane defined by said upper face and adjacent a respective corner of said block, wherein said hooks are configured to enable said blocks to be lifted, and wherein said upper face of at least some of said blocks includes a plurality of parallel grooves, and wherein each said hook is disposed within one of said grooves.

2. The erosion control system of claim 1, wherein said blocks comprise concrete, and wherein each said block includes an internal frame made of metal embedded within said concrete.

3. The erosion control system of claim 1, wherein said linkage connector assembly comprises a pair of U-shaped brackets and a fastener with said U-shaped brackets configured to be disposed about respective ones said coupling rods of said aligned said connector recesses and connected together with said fastener.

4. The erosion control system of claim 1, wherein each said block includes an embedded perimeter frame member, and wherein portions of said perimeter frame member are exposed at said connector recesses, and wherein said coupling rods are formed by said exposed portions of said perimeter frame member.

5. The erosion control system of claim 4, further comprising an internal frame that includes a metal grid, wherein a plurality of hooks are affixed to said metal grid.

6. The erosion control system of claim 1, wherein each said connector recess includes an additional coupling rod with said coupling rods of said connector recesses defining an upper connecting rod and a lower connecting rod, wherein said upper and lower coupling rods each span said connector recess laterally inward from said outer surface of said sides, and wherein said linkage connector assembly is configured to connect either (i) said upper connecting rods of said aligned said connector recesses of adjacent said blocks, or (ii) said lower connecting rods of said aligned said connector recesses of adjacent said blocks.

7. The erosion control system of claim 6, wherein each said block includes an upper embedded perimeter frame member and a lower embedded perimeter frame member, and wherein portions of said upper and lower perimeter frame members are exposed at said connector recesses, and wherein said upper coupling rods are formed by said exposed portions of said upper perimeter frame member and said lower coupling rods are formed by said exposed portions of said lower perimeter frame member.

8. The erosion control system of claim 1, wherein each said block includes four said sides and at least one connector recess on at least two of said sides.

9. The erosion control system of claim 1, wherein each said block includes four said sides and is square, and includes a pair of connector recesses on each said side.

10. The erosion control system of claim 1, wherein at least some of said blocks include a through hole extending from said upper face to said bottom face, and wherein said through hole is configured to receive a piling for securing said block.

11. The erosion control system of claim 1, wherein said block comprises a pair of connector recesses on at least one of said sides, and wherein a respective one of said coupling rods extends through said pair of connector recesses.

12. An erosion control block, said block comprising:

an upper face, a lower face, and a plurality of sides, and connector recesses disposed on at least some of said sides, wherein each said connector recess extends inwardly from an outer surface of the respective said side at which said connector recess is disposed, wherein said connector recesses are configured to enable said block to connect with additional blocks;

wherein each said connector recess includes at least one coupling rod;

wherein said block includes at least one embedded perimeter frame member, and wherein portions of said at least one embedded perimeter frame member are exposed at said connector recesses;

wherein said at least one coupling rod is formed by said exposed portions of said at least one perimeter frame member;

wherein said exposed portions of said at least one perimeter frame member are laterally spaced inwardly from said outer surface of said sides of said block; and wherein each said side has a length and a thickness and wherein the length of each said side is greater than the thickness;

wherein said block includes a plurality of metal hooks disposed beneath a plane defined by said upper face and adjacent a respective corner of said block, wherein said hooks are configured to enable said blocks to be lifted; and wherein said upper face of said block includes a plurality of parallel grooves, and wherein each said hook is disposed within one of said grooves.

13. The erosion control block of claim 12, wherein said block comprises concrete.

14. The erosion control block of claim 13, wherein said block includes an internal frame made of metal embedded within said concrete.

15. The erosion control block of claim 12, wherein said block includes four said sides and is square, and includes a pair of connector recesses on each said side.

16. The erosion control block of claim 12, wherein at least some of said blocks include a through hole extending from said upper face to said bottom face, and wherein said through hole is configured to receive a piling for securing said block.

17. The erosion control block of claim 12, wherein said at least one perimeter frame member corresponds to a perimeter of said block.

18. An erosion control system, said system comprising:

a plurality of interconnected blocks, each block comprising an upper face, a lower face, and a plurality of sides, and connector recesses disposed on at least some of said sides, wherein each said connector recess extends inwardly from an outer surface of the respective said side at which said connector recess is disposed;

wherein each said block is configured to be connected with an adjacent said block with one of said sides of each said block being disposed adjacent one of said sides of said adjacent said block and at least one said connector recess of each said block aligned with one of said connector recesses of said adjacent said block;

wherein adjacent said blocks are connected together at aligned said connector recesses by a linkage connector assembly, and wherein adjacent said blocks are able to pivot relative to each other via said linkage connector assembly; and wherein each said connector recess includes a coupling rod spanning said connector recess laterally inward from said outer surface of said sides, and wherein said linkage connector assembly connects with said coupling rods of said aligned said connector recesses of adjacent said blocks, wherein each said block includes an embedded perimeter frame member, and wherein portions of said perimeter frame member are exposed at said connector recesses, and wherein said coupling rods are formed by said exposed portions of said perimeter frame member, and further comprising an internal frame that includes a metal grid, wherein a plurality of hooks are affixed to said metal grid.

19. The erosion control system of claim 18, wherein each said connector recess includes an additional coupling rod with said coupling rods of said connector recesses defining an upper connecting rod and a lower connecting rod, wherein said upper and lower coupling rods each span said connector recess laterally inward from said outer surface of said sides, and wherein said linkage connector assembly is configured to connect either (i) said upper connecting rods of said aligned said connector recesses of adjacent said blocks, or (ii) said lower connecting rods of said aligned said connector recesses of adjacent said blocks.

20. The erosion control system of claim 18, wherein at least some of said blocks include a through hole extending from said upper face to said bottom face, and wherein said through hole is configured to receive a piling for securing said block.

* * * * *